US008210013B2

(12) United States Patent
Rossigneux

(10) Patent No.: US 8,210,013 B2
(45) Date of Patent: Jul. 3, 2012

(54) METHOD OF MANAGING CYLINDERS IN A ROLLING FACILITY AND INSTALLATION FOR IMPLEMENTING SAME

(75) Inventor: Bernard Rossigneux, Lezigneux (FR)

(73) Assignee: Siemens VAI Metals Technologies SAS, Saint-Chamond (FR)

( * ) Notice: Subject to any disclaimer, the term of this patent is extended or adjusted under 35 U.S.C. 154(b) by 820 days.

(21) Appl. No.: 12/084,925

(22) PCT Filed: Nov. 23, 2006

(86) PCT No.: PCT/FR2006/051223

§ 371 (c)(1),
(2), (4) Date: May 13, 2008

(87) PCT Pub. No.: WO2007/060370

PCT Pub. Date: May 31, 2007

(65) Prior Publication Data

US 2009/0165522 A1 Jul. 2, 2009

(30) Foreign Application Priority Data

Nov. 25, 2005 (FR) ..... 05 53604

(51) Int. Cl.
*B21B 31/08* (2006.01)
*B21B 31/00* (2006.01)

(52) U.S. Cl. ..... 72/239

(58) Field of Classification Search ..... 72/237–239
See application file for complete search history.

(56) References Cited

U.S. PATENT DOCUMENTS 3,289,282 A 12/1966 Shaffer
3,665,746 A * 5/1972 Eibe ..... 72/239
3,712,102 A * 1/1973 Eibe ..... 72/238

(Continued)

FOREIGN PATENT DOCUMENTS

DE 10 2004 007 831 A1 9/2005

(Continued)

OTHER PUBLICATIONS

Patent Abstracts of Japan—JP 63220913 A; Sep. 14, 1988; NKK Corp.

(Continued)

*Primary Examiner* — Edward Tolan
*Assistant Examiner* — Pradeep C Battula
(74) *Attorney, Agent, or Firm* — Laurence A. Greenberg; Werner H. Stemer; Ralph E. Locher

(57) ABSTRACT

In a method to replace a pair of rolls of a rolling mill stand during a downtime period, worn rolls fitted with chocks are extracted from the mill stand and positioned on means of displacement that bear a pair of new rolls without chocks. The method sets the means of displacement in motion so that the worn rolls are aligned with a chock extraction device. The chock extraction device is used to remove the chocks from the worn rolls. The means of displacement are actuated so that new rolls are now aligned with the chock extraction device. The chock extraction device is used to reinstall, on the new rolls, the chocks. After the new rolls have been fitted with the chocks, the new rolls are inserted in the mill stand so that the downtime period is reduced and the number of chocks in service is likewise reduced.

7 Claims, 4 Drawing Sheets

U.S. PATENT DOCUMENTS

| | | | | |
|---|---|---|---|---|
| 3,782,161 | A | 1/1974 | McGeeney et al. | |
| 4,771,626 | A | 9/1988 | Ichida et al. | |
| 6,408,667 | B1 * | 6/2002 | de Jesus, Jr. | 72/239 |
| 6,672,124 | B2 * | 1/2004 | Minnerop et al. | 72/239 |
| 2002/0078728 | A1 * | 6/2002 | Mukaigawa et al. | 72/239 |
| 2005/0000263 | A1 * | 1/2005 | Wittkopf | 72/239 |
| 2006/0144114 | A1 | 7/2006 | Benner | |

FOREIGN PATENT DOCUMENTS

| | | | |
|---|---|---|---|
| JP | 61222616 | A | 10/1986 |
| JP | 02200309 | A * | 8/1990 |
| JP | 4009203 | A | 1/1992 |
| JP | 523721 | A | 2/1993 |
| JP | 8001213 | A | 1/1996 |

OTHER PUBLICATIONS

Derwent Abstract—DE-10 2004 007 831 A1; Sep. 1, 2005; SMS Demag AG, D-40237 Düsseldorf, Germany.

* cited by examiner

METHOD OF MANAGING CYLINDERS IN A ROLLING FACILITY AND INSTALLATION FOR IMPLEMENTING SAME

CROSS-REFERENCE TO RELATED APPLICATIONS

The present application is a national stage application of International Application No. PCT/FR2006/051223, filed on Nov. 23, 2006, which claims priority to French Patent Application No. 0553604, filed on Nov. 25, 2005, which are incorporated herein by reference.

BACKGROUND OF THE INVENTION

The invention relates to the field of methods and installations for changing over the rolls of a rolling mill.

During the operation of a rolling mill, the aging of the work rolls that are in contact with the product to be rolled, or that of other rolls such as the intermediate rolls, or again, although less significant, that of the backup rolls, poses a risk of resulting in the production of a defective rolled product or the damaging of the rolls themselves.

Moreover, during a change-over in type of production, it may be necessary to replace a pair of rolls with another pair of rolls having, for example, a different roughness or a different hardness.

These are the reasons why, from time to time, the rolling mill installation has to be stopped for the replacement of one or more pairs of rolls. In general terms, in the following, reference will be made to the replacement of worn rolls with new rolls, while bearing in mind that the change-over of rolls may be prompted by reasons other than wear alone.

Each of the ends of a roll in a mill stand carries a chock incorporating the bearings allowing the roll to be set in rotation about its axis. In operation, the chocks are capable of sliding vertically in guide slots realized in each of the pillars of the mill stand. In the following, a fitted roll is a roll on which chocks have been mounted.

According to the prior art, a method for changing over rolls comprises a succession of handling operations on the rolls carried out by the maintenance personnel. The sequence of operations is generally as follows:

- The extraction of at least one pair of worn rolls fitted with chocks out of a mill stand of the rolling mill. This operation generally demands a device currently referred to as a "dismantling car" fitted with means for the displacement of rolls. According to how modern the installation is, the attachment of the rolls to the body of the roll displacement means is manual or automatic.
- The removal of the pair of worn rolls fitted with their chocks to a maintenance zone referred to as the rolls workshop. This operation demands traditional means of handling such as a traveling crane serving the rolling mill plant. Operatives then have the task of trimming slings on the rolls.
- A pair of new rolls fitted with chocks is brought from the maintenance zone up to the dismantling car by the traveling crane. The pair of new fitted rolls is put down on the dismantling car. In more modern arrangements, the new fitted rolls can be pre-positioned on the dismantling car by way of suitable devices such as those described in the patent US 2005/000263.
- The new fitted rolls are subsequently reinstalled in the mill stand, which can start rolling operations again.

During this time, the worn rolls fitted with chocks are removed to the rolls workshop. Maintenance operatives withdraw the chocks from the necks of each roll. To this end, the rolls workshop can be provided with a device for extracting and reinstalling chocks of the type described in the document JP-A-63-220913.

The active surface of the rolls is then overhauled by machining on a grinding machine. After an inspection stage on the quality of the re-ground surfaces, the maintenance operatives reinstall the chocks on the necks of the rolls, which are then available to be brought close to the rolling mill.

Such a succession of operations, which is repeated for all the mill stands of the rolling mill, presents certain disadvantages.

Firstly, numerous operations necessitate the intervention of operatives, particularly for the handling of very heavy mechanical elements, in high-risk working zones close to the rolling mill.

Then, the regulations are evolving in order to raise the level of safety in respect of the personnel having to intervene at any phase of operation of the rolling mill.

Additionally, the roll change-over method as a whole is relatively slow. In particular, the inevitable trip to the workshop made by the rolls may deprive the operator of the possibility of quickly switching rolls in case of need, for example in order to adapt the rolling mill to a change-over in type of production. This is particularly true in certain special applications where the quantities rolled in each campaign are relatively small.

Thus, the document U.S. Pat. No. 4,771,626 describes an installation for changing over rolls comprising, from the operative side of the rolling mill, a car fitted with a frame for changing over a group of rolls and means of displacement for the rolls designated as "push-pull" in order to load and unload a group of rolls from the change-over frame. The car is moved close to and away from the mill stand that it serves, in order to extract and reinstall a group of rolls in the corresponding mill stand in the first position, and in order to operate together with a shuttle in the second position. According to this document, the shuttle comprises a single exchange frame similar to that of the car. The shuttle is moved in a direction parallel to the rolling direction, between a position of operating together with the car, the frame of the car and of the shuttle then being aligned for the transfer of the worn fitted rolls from the car to the shuttle or the new fitted rolls from the shuttle to the car, and a position away from the displacement zone of the cars. The installation likewise comprises a rack and a second shuttle. The rack is located away from the displacement zone of the cars, on which the shuttle, likewise fitted with roll displacement means, puts down the worn fitted rolls and loads the new fitted rolls. The second shuttle is used to transfer the worn fitted rolls located on the rack to the rolls workshop and vice versa in the case of new fitted rolls.

According to this prior art, it is necessary to move the empty first shuttle into alignment with the car in order to transfer the worn fitted rolls from the car to the shuttle, to move the shuttle opposite an empty bay of the rack in order to put the worn fitted rolls down there, and then to move the shuttle opposite another bay of the rack in order to load the new fitted rolls. The shuttle is moved into alignment with the car once again in order to load the new fitted rolls there. Finally, the shuttle is moved away from the car in order to be able to move the car toward the mill stand.

But above all, according to the known methods, it is necessary to arrange, at any point in time, sets of rolls fitted with chocks in sufficient quantity to ensure the switching of the rolls. Typically, for a rolling mill with 5 mill stands, 10 work rolls are in service and 10 are on standby in order to ensure the replacement of the rolls in service. This therefore represents the immobilization of (10+10)×2–40 chocks. To this is generally added another set of 10 spare rolls, likewise fitted with chocks, allowing rolls suffering an incident during rolling operations to be changed over quickly, while those dismantled previously are undergoing re-machining by means of grinding in the rolls workshop. The total number of chocks in circulation at any time is thus generally 60. This large number of chocks represents a major investment cost for the installations according to the prior art.

SUMMARY OF THE INVENTION

The object of the invention is to compensate, in very large measure, for the disadvantages referred to above by way of a new method for changing over the rolls of a rolling mill and an appropriate installation for implementing this method.

Additionally, the roll change-over installation for implementing this method should be capable of being realized on existing rolling installations. It is therefore necessary for the roll change-over installation to comply with constraints in terms of space that are compatible with the existing rolling installations.

Furthermore, such an installation must be particularly simple, easy to maintain, and capable of being realized with a limited investment.

For this purpose, the object of the invention is an installation for the on-line replacement of at least one pair of rolls of a rolling mill comprising a plurality of mill stands arranged in series along an axis of rolling, the installation comprising:

- a plurality of dismantling cars, the number of dismantling cars being equal to the number of mill stands of the rolling mill installation, each dismantling car serving one associated mill stand and being moved along rails arranged perpendicular to the axis of rolling, between a retracted position and an advanced position with respect to the associated mill stand, each car being fitted with a replacement frame in order to accommodate a group of rolls and roll displacement means allowing the rolls to be slid parallel to their respective axes over a given distance outside and inside the replacement frame;
- a shuttle device capable of being moved along rails arranged parallel to the axis of rolling.

According to the invention, the installation is characterized in that it comprises at least one chock extraction device allowing the chocks to be coupled and uncoupled at the ends of rolls aligned with the chock extraction device, and in that said shuttle device comprises first and second exchange frames, the shuttle device being moved in order that one or other of the first and second exchange frames is alternatively in alignment with the replacement frame of the car and with the chock extraction device.

Preferably, the installation is entirely automatic.

In one embodiment, the chock extraction device is arranged on the shuttle device and in that the shuttle device comprises a transposing means in order to move the first and second exchange frames with respect to the chock extraction device.

In another embodiment, the chock extraction device is located along the rails for moving the shuttle device, on each side of the traversing path of the shuttle device.

In one embodiment of the shuttle device, the latter comprises a number of exchange frames that is greater by one unit than the number of mill stands and cars of the rolling mill.

In another embodiment of the shuttle device, the latter comprises a number of exchange frames that is equal to twice the number of mill stands and cars of the rolling mill.

Preferably, the shuttle device allows rolls to be transported from one roll change-over zone close to the rolling mill to a rolls workshop, and vice versa.

Preferably, the distance D of the order of 10 m to 30 m separates the advanced position of the car from the retracted position of the car in order to allow the operative side of the rolling mill to be freed up.

The object of the invention is likewise a method for the on-line replacement of at least one pair of rolls of a rolling mill stand, characterized in that it consists in:

- advancing a car associated with the mill stand under consideration to an advanced position close to the mill stand;
- stopping rolling operations;
- actuating roll displacement means with which the car is fitted in order to extract from the mill stand, by means of sliding along their respective axes, the worn rolls fitted with chocks in order to arrange them on a replacement frame with which the car is fitted;
- retracting the car to a retracted position away from the mill stand;
- moving a shuttle device, equipped with an empty first exchange frame and a second exchange frame bearing new rolls without chocks, to a first position in which the first exchange frame is aligned with the replacement frame of the car;
- actuating the roll displacement means of the car in order to transfer the worn rolls fitted with chocks from the frame to the first exchange frame;
- aligning the first exchange frame of the shuttle device with a chock extraction device;
- operating the chock extraction device in order to uncouple the chocks from the ends of the worn rolls placed in the first exchange frame;
- aligning the second exchange frame of the shuttle device with the chock extraction device;
- operating the chock extraction device in order to couple the chocks to the ends of the new rolls placed in the second exchange frame;
- moving the shuttle device to a second position in which the second exchange frame is aligned with the replacement frame of the car;
- actuating the roll displacement means in order to slide the new rolls fitted with chocks from the second exchange frame to the replacement frame;
- advancing the car to its advanced position;
- actuating the roll displacement means in order to insert the new rolls fitted with chocks from the replacement frame into the associated mill stand; and
- restarting rolling operations.

In a first embodiment, since the chock extraction device is mounted on the shuttle device, the alignment of the first exchange frame or the second exchange frame with the chock extraction device consists in actuating a transposing means supporting the first and second exchange frames with which the shuttle device is equipped.

In another embodiment, since the chock extraction device is arranged on each side of the traversing path of the shuttle device, the alignment of the first exchange frame or the second exchange frame with the chock extraction device consists in moving the shuttle device.

Preferably, the shuffle device is moved to the rolls workshop where the first exchange frame is emptied of the worn rolls without chocks and the second exchange frame is loaded with new rolls without chocks, the shuttle device being moved once again into the roll change-over zone into a standby position with a view to the next roll change-over cycle.

Alternatively, since the car is capable of being moved to the rolls workshop, the method comprises the stages consisting in, after having inserted the new rolls fitted with chocks in the mill stand, retracting the car to the retracted position, aligning the first exchange frame of the shuttle device with the replacement frame of the car, actuating the roll replacement means of the car in order to slide the worn rolls from the first exchange frame into the replacement frame of the car, setting the car in motion toward the rolls workshop where the replacement frame is emptied of the worn rolls without chocks and then loaded with the new rolls without chocks, setting the car in motion toward the roll change-over zone close to the rolling mill in its retracted position, aligning the second exchange frame of the shuttle device with the replacement frame of the car, and actuating the roll replacement means in order to slide the new rolls without chocks from the replacement frame to the second exchange frame with a view to the next roll change-over cycle.

By way of advantage, the method consists in realizing an on-line change-over of the chocks, close to the rolling mill, during the roll change-over operation. Thus, the number of chocks and associated bearings is reduced. For the rolling mill with 5 mill stands already considered, the necessary quantity is 10×2=20 bearings and chocks, to which are added 2 to 3 emergency sets, making a maximum of 20+(3×4)=32 bearings and chocks.

The method according to the invention permits a large amount of operating flexibility of the rolling mill by allowing the most appropriate rolls for the next rolling campaign to be held ready, prepared for action, on the shuttle device, and the stoppage time of the rolling mill to be limited to the minimum.

By way of advantage, the installation according to the invention makes very good use of coupling devices allowing a chock to be coupled easily to the end of a roll. In particular, the applicant has developed quick-acting locking/unlocking systems for chocks. Such mounting devices are described, for example, in the document FR-9209477. The use of such coupling devices allows all human intervention to be completely eliminated for the mounting and dismantling operations on the chocks during the change-over of the rolls. Given that such a change-over takes place in the immediate vicinity of the rolling mill, the installation according to the invention which can be entirely automated is much safer.

In general, the replacement of the rolls of the different mill stands of the rolling mill is realized during a single stoppage of rolling operations. According to the prior art, replacement is realized mill stand by mill stand. In fact, replacements carried out simultaneously on the entirety of the mill stands would pose major risks for safety around the rolling mill. According to the invention, it is accepted that the time necessary for the replacement of the rolls of a mill stand under consideration is increased by adding the stages necessary for the exchange of the chocks between the worn rolls and the new rolls. However, the replacement of the rolls of the next mill stand can begin (stages of moving the corresponding car and extracting the worn rolls out of the next mill stand) while the stages for exchanging the chocks for the mill stand under consideration are in the course of being realized. Apart from the iteration of the stages for exchanging the chocks for the last mill stand of the rolling mill, the time necessary in order to carry out the chock exchange stages can be hidden in a conveniently synchronized overall operation.

BRIEF DESCRIPTION OF THE SEVERAL VIEWS OF THE DRAWINGS

Other objects, details, characteristics and advantages of the invention will become apparent from the description of a particular embodiment of the invention provided solely in an illustrative and not exhaustive manner by reference to the attached drawings. In these drawings.

DETAILED DESCRIPTION OF THE INVENTION

Figure 1:
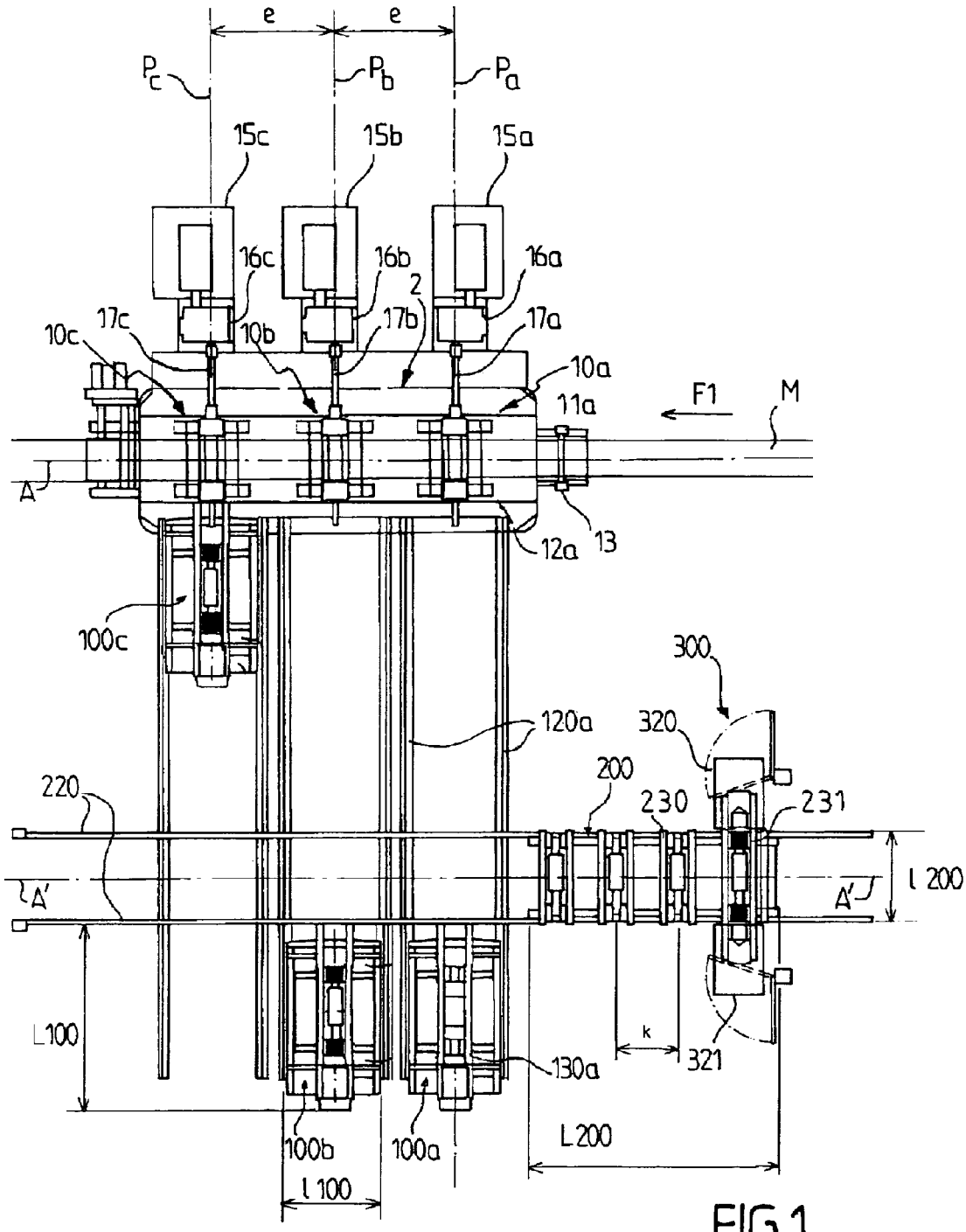
FIG. 1 is a view from above of a first embodiment of the installation according to the invention.
Figure 2:
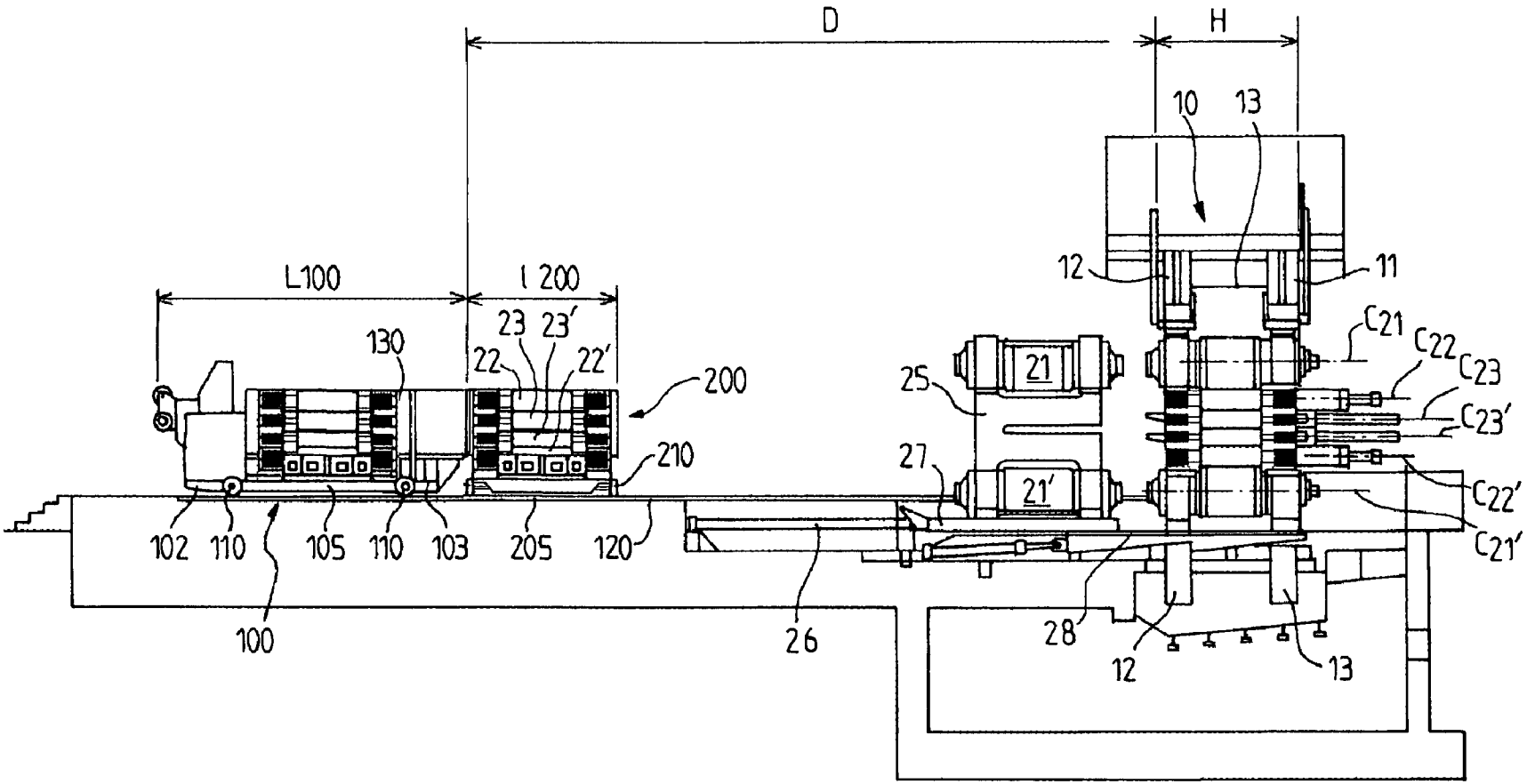
FIG. 2 is a sectional view of the installation according to the line II-II in FIG. 1.

FIGS. 1 and 2 represent a preferred embodiment of the roll change-over installation according to the invention with which a rolling mill is provided.

Referring to FIG. 1, a strip of sheet metal M to be rolled is moved along an axis of rolling A in the direction of travel indicated by the arrow F1. The strip M enters the rolling mill 2 on the right of FIG. 1, coming for example from a coil arranged upstream of the rolling mill 2, and exits at the desired thickness on the left of FIG. 1 where it is wound up, for example, on a spindle coiler arranged downstream of the rolling mill 2.

In the example represented, the rolling mill 2 comprises three mill stands 10*a*, 10*b* and 10*c*, all identical to each other. The three mill stands 10 are arranged in series along the axis of rolling A, with a spacing e.

As is customary, each mill stand 10 comprises a framework made up of two side pillars 11 and 12, between which the sheet metal M to be rolled passes, joined together by a connecting beam 13. Inside this framework, the mill stand 10 comprises a plurality of rolls arranged horizontally on top of each other, their respective axes being placed in parallel and resting roughly in a principal plane P perpendicular to the axis of rolling A (plane of FIG. 2). The rolls are mounted so as to rotate in chocks supported by guide bodies housed in a window realized in each side pillar 11 and 12. The guide bodies permit a certain vertical mobility for the rolls, by means of the sliding of the guide bodies along the vertical walls of the windows.

The different rolls of the mill stand 10 are associated in pairs, the rolls of each pair being arranged respectively on each side of the sheet metal to be rolled M. The mill stands 10 with which the installation according to the invention is provided can be of any known type, for example of the four-high or six-high type. For example, if the mill stand 10 is of the four-high type, it comprises two work rolls of small diameter arranged on each side of the product to be rolled and two backup rolls of larger diameter arranged on each side of the pair of work rolls. If, as is the case in the embodiment represented in FIGS. 1 and 2, the mill stand 10 is of the six-high type, it comprises one bottom backup roll 21' of axis $C'_{21}$, one intermediate roll 22' of axis $C'_{22}$, one work roll 23' of axis $C'_{23}$, and then, above the plane of rolling in which the strip is progressing, one work roll 23 of axis $C_{23}$, one intermediate roll 22 of axis $C_{22}$, and one backup roll 21 of axis $C_{21}$.

In the following, the expression "group of rolls" designates the entirety of the rolls to be replaced in one operation, an entirety being made up of the work rolls and/or the intermediate rolls. In fact, since the replacement of the backup rolls is much less frequent, it is not necessary to set forth a method allowing the quick change-over of all the pairs of rolls of a mill stand. If the backup rolls have to be changed over, it is preferable to do so according to a method and with specific means. By way of advantage, the arrangement of the constituent elements of the roll change-over installation is such that the zone close to the mill stands, on the operative side, is free when the cars are in their position away from the mill stands.

For example, represented to the left of the mill stand 10 in FIG. 2 is a pair of backup rolls 21, 21', which have just been extracted from the mill stand 10. In order to extract the backup rolls, it is first necessary to take steps to extract the work rolls and the intermediate rolls, then position a spacer 25 allowing the top backup roll 21 to be kept in its relative position with respect to the bottom backup roll 21'. Then, by actuating a ram 26 allowing the displacement, by way of transposition, of a slide 27 along the rail 28 arranged perpendicular to the axis of rolling A, the pair of backup rolls, resting on the slide 27, is extracted laterally from the mill stand 10.

The pairs of work rolls 23 and 23' and intermediate rolls 22 and 22' are driven to rotate by drive means comprising a motor 15, reduction means 16, and extension pieces 17. Consequently, the motor side of the rolling mill is difficult to access for the workers in charge of the maintenance of the rolling mill. It is for this reason that the means for the change-over of the rolls are arranged in a working zone, referred to as the operative side, located on the side of the axis of rolling A opposite the motor side.

During rolling operations, the rolls are subjected to deformation, deterioration of their surface condition, and wear. It is therefore necessary to change over the rolls on a regular basis so as to retain a standard quality for the product to be rolled by avoiding a progressive decline.

The rolls can be replaced individually but they are preferably replaced in pairs. Although the different pairs of rolls age in a different manner during the use of the rolling mill, different pairs of rolls can be replaced during the same operation. It is this preferred embodiment that is represented in the figures.

The roll change-over installation comprises a plurality of cars 100*a*, 100*b* and 100*c*, all identical to each other. Each car is associated with one mill stand, which it serves. The number of cars therefore corresponds to the number of mill stands of the rolling mill.

A car 100 comprises a rectangular platform 105 with a length L100 and a width I100. The platform 105 is equipped, at its front end 103, with a replacement frame. The replacement frame 130 allows a group of rolls to be accommodated in a relative position corresponding precisely to the position that they will have once inserted in the mill stand. The replacement frame comprises a slideway system allowing the sliding of a group of rolls in the principal plane P. The chocks of the rolls in the group comprise small wheels operating together with the slideways of the pillars of the mill stand and the slideways of the replacement frame in a manner such that the group can slide toward the inside of the replacement frame when the rolls are pulled onto the replacement car or toward the outside of the replacement frame when the rolls are pushed out of the car.

Finally, the platform 105 is fitted with a roll displacement means allowing the group of rolls to be moved by means of horizontal transposition in the principal plane P over a predetermined distance V. The roll displacement means consists essentially in a gripping device capable of catching at least one of the operative-side chocks of the group to be handled, and drive means, such as rams, capable of pulling or pushing the group of rolls.

The platform 105 is equipped, at its rear end 102, with means of propulsion which move the car along a horizontal axis located in the principal plane P of the associated mill stand. The platform 105 is equipped with four wheels 110 allowing it to be moved along rails 120. The car 100, which may be referred to as a first car, can be moved between two end positions:

- an advanced position close to the mill stand 10, such that the roll displacement means can either push the group of new rolls into the mill stand 10 or pull the group of worn rolls out of the mill stand 10. In order to arrange the rolls symmetrically with respect to a vertical plane comprising the axis of rolling A, it is necessary for the front of the car 100, in its position close to the mill stand, to be at a distance H/2 of the axis A, where H is the length of the rolls;
- a retracted position away from the mill stand 10, such that the roll displacement means can push the group of worn rolls onto a shuttle 200, which may be referred to as a second car, or pull the group of new rolls from the shuttle 200 onto the car 100. The retracted position of the mill stand 10 is defined geometrically by the fact that the front of the car 100 is then at a distance D with respect to the position that it occupies in the advanced position. It should be noted that the distance of retraction D is selected such that it is not, on the one hand, too large, with the aim of limiting the time necessary in order to execute the displacement travel of the car 100, or, on the other hand, too small, with the aim of freeing up the operative side in order to allow movement of the workers and access to the mill stands.

The installation according to the invention likewise comprises a single shuttle 200. The shuttle 200 is made up of a platform 205, which is essentially rectangular, of length L200 and width I200.

The platform 205 is mounted on four wheels 210 allowing the shuttle 200 to be moved along rails 220. The shuttle 200 is moved along an axis A', parallel to the axis of rolling A, the movement of the shuttle 200 therefore being accomplished perpendicular to the movements of the cars 100 *a-c*.

In an embodiment shown in the figures, the platform 205 comprises the first and one second exchange frame 230, 231 arranged parallel to each other within the width of the shuttle 200. They are offset from each other by a pitch k according to the axis A'. These first and second exchange frames are respectively identical to the replacement frame of the car 100. In particular, they are equipped with sideways which, when they are aligned with the slideways of the replacement frame, allow the sliding of a group of rolls.

The method according to the invention, which will be described in greater detail below, consists in transferring, by means of sliding, a group of worn rolls from the replacement frame of the car 100 to the first exchange frame 230 of the shuttle 200, and, vice versa, a group of new rolls from the second exchange frame 231 of the shuttle 200 to the replacement frame 130 of the car 100. Given that the means of displacement of the car 100 moves a group of rolls over a span V, and taking account of the fact that the transfer of the rolls from the car 100 to the shuttle 200, or vice versa, is accomplished, in this embodiment, when the car 100 is in its retracted position, the axis A' of displacement of the shuttle 200 is located at a distance from the axis of rolling A that is roughly equal to the retraction distance D of the car 100.

The shuttle 200 can occupy two relative working positions with respect to each of the cars 100 *a, b*, and *c*. In a first position, the median vertical plane of the first exchange frame 230 coincides with the principal plane P of the mill stand 10 and therefore the replacement frame of the corresponding car 100. The group of worn rolls borne by the car 100 can be loaded onto the shuttle 200 by means of horizontal transposition in the plane P, the means of displacement of the car 200 then operating in push mode.

Then, the shuttle 200 is set in motion along the axis A' for a distance corresponding to the pitch k in such a way that the median plane of the second exchange frame 231 is now situated in the principal plane P of the mill stand 10 and therefore of the replacement frame of the corresponding car 100. The group of new rolls present on the shuttle 200 is then loaded onto the car 100 by means of horizontal transposition in the plane P, the means of displacement of the rolls operating in traction mode.

The shuttle 200 can likewise occupy different positions away from the cars 100 a, b, and c in which it does not block the to-and-fro movement of these latter cars.

In the embodiment of FIGS. 1 and 2, the shuttle 200 can be moved away from the cars 100 in order to be brought closer to a chock extraction device 300.

In the embodiment depicted in FIGS. 1 and 2, a chock extraction device 300 is located at a fixed site of the roll change-over installation, along the traversing path of the shuttle 200.

In a manner so as to automate the entirety of the roll change-over operations to the maximum extent, use is made of chocks that can be coupled and uncoupled automatically at the ends of the rolls.

The chock extraction device 300 comprises two banks of chock extractors 320 and 321 arranged facing each other and located on each side of the rails 220.

When the shuttle 200 brings a group of worn rolls from which the chocks have to be withdrawn, the shuttle 200 is moved in such a way that the median plane of the first exchange frame 230 bearing this worn group is aligned with the banks of chock extractors. The extraction of the chocks is then realized. Each of the chock extractors takes away the chock that has just been uncoupled from the roll. The shuttle 200 is then moved over a distance corresponding to the pitch k, in such a way that the median plane of the second exchange frame 231, comprising a group of new rolls without chocks, is in alignment with the banks of chock extractors. The chocks brought by each of the chock extractors are then coupled to the respective ends of the different new rolls. This group of new rolls fitted with chocks can subsequently be mounted in a mill stand.

In another embodiment represented in FIG. 3, the chock extraction device 300' is mounted directly on the shuttle 200'. In this case, in order to ensure that the median plane of the exchange frames 230 and 231 coincides with the banks of chock extractors, the shuttle 200' comprises a mobile deck 250 bearing the first and second exchange frames 230, 231. The actuation of this means of transposition of the exchange frames allows these latter frames to be moved longitudinally with respect to the shuttle 200' and therefore with reference to the chock extraction device 300'.

This embodiment is particularly suitable for a rolling mill where it is not necessary to undertake the change-over of all the groups of rolls simultaneously, but instead where the replacements of the groups are accomplished successively.

When it has been decided to replace a group of rolls, the method starts with an initial phase for transfer of the worn rolls from the mill stand 10 onto the associated car 100. The car 100 is advanced along the rails 120 to its advanced position close to the mill stand 10. The slideways of the replacement frame are then arranged opposite the slideways of the pillars. The actuation of the roll displacement means allows the easy loading of the group from the mill stand to the car by means of the rolling of the small wheels of the chocks along the slideways thus forming a continuous entirety.

Once the group of worn rolls has been loaded onto the car 100, the latter is retracted in order to be positioned in its retracted position at a retraction distance D with respect to the side pillar on the operative side of the mill stand 10. In order that the car 100 can reach this position, taking account of the crossing of the rails 120 and the rails 220, the shuttle 200' is in a standby position away from the displacement path of the car 100.

Figure 3A:
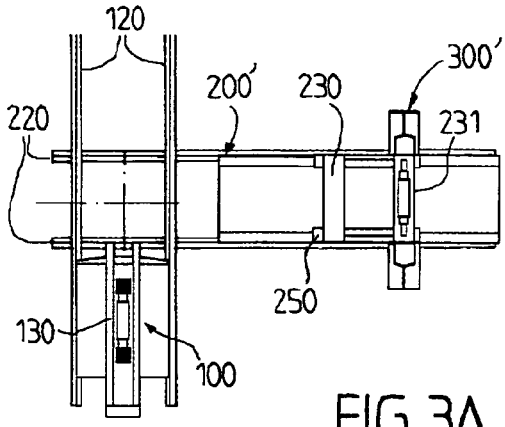
FIGS. 3A to 3J depict the different stages of the method according to the invention, implemented in a second embodiment of the installation according to the invention.

As represented in FIG. 3A, at this point in the method, the second exchange frame 231 comprises by way of advantage a group of new rolls without chocks.

Figure 3B:
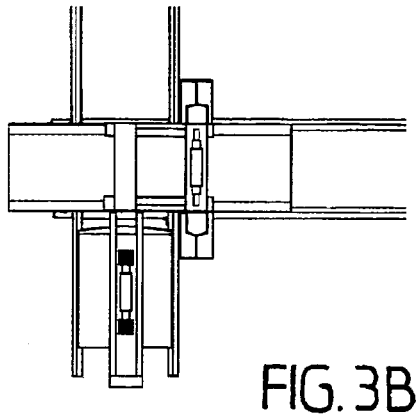
Figure 3C:
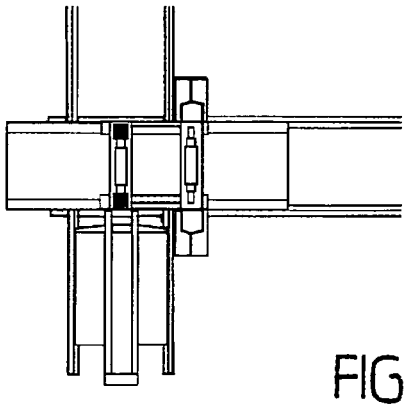

Referring to FIG. 3B, the shuttle 200' has approached in front of the car 100 and is set in a first relative position in such a way that the first exchange frame 230 is positioned in the principal plane P in alignment with the replacement frame of the car 100. In this first relative position, the roll displacement means of the car 100 are actuated in order to transfer the group of worn rolls from the replacement frame 100 into the first exchange frame (FIG. 3C).

Figure 3D:
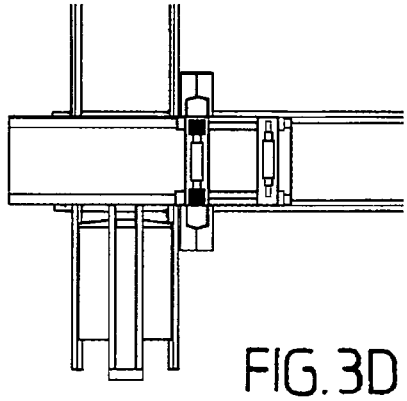

Once the group of worn rolls has been loaded onto the shuttle 200', the mobile deck 250 of the shuttle 200' is transposed in order that the first exchange frame 230 can operate together with the chock extraction device placed on the shuttle 200 (FIG. 3D). More particularly, the axis of each of the rolls is positioned in alignment with the pair of chock extractors of the chock extraction device.

Figure 3E:
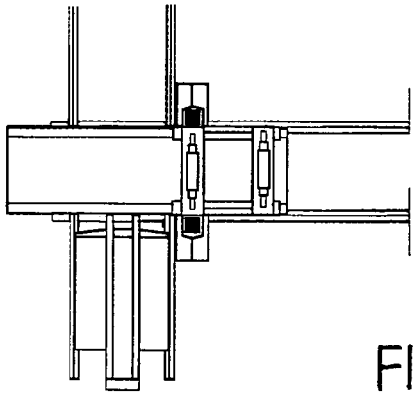

In FIG. 3E, the actuation of the banks of chock extractors 320 and 321 is represented. One extractor is advanced axially toward the chock to be extracted, grasps this latter chock while unlocking the coupling system from the chock and the end of the roll, and is then returned to its original position while drawing the chock with it. The chock is moved away sufficiently far from the roll in order that the latter can subsequently be moved relative to the chock extraction device according to the axis A'.

Figure 3F:
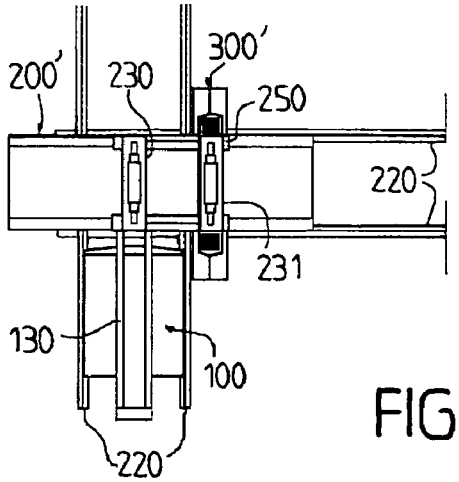

In FIG. 3F, the mobile deck 250 of the shuttle 200 is once again actuated by way of transposition over a distance corresponding to the pitch k in order that the second exchange frame 231 is situated in a position to operate together with the chock extractor 300. The axis of each of the new rolls present in the second exchange frame 231 is in alignment with a pair of extractors.

Figure 3G:
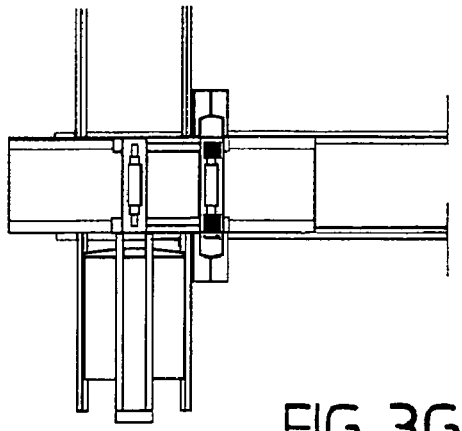

Then, at the stage represented in FIG. 3G, the chocks that had been withdrawn from the worn rolls are coupled to each of the ends of the new rolls. The coupling of the chocks onto the ends of the rolls is an operation that is essentially similar to the operation of uncoupling described previously.

Figure 3H:
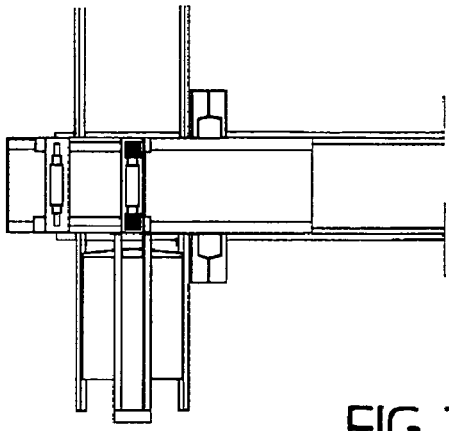

In FIG. 3H, the shuttle 200 is displaced along the axis A' in order to reach a position in which the second exchange frame 231 bearing the group of new rolls fitted with chocks is situated in the principal plane P, in alignment with the replacement frame of the car 100.

Figure 3I:
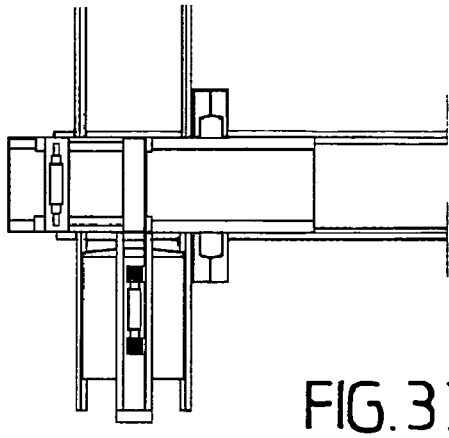

At the stage represented in FIG. 3I, the actuation of the roll displacement means of the car 100 allows the transfer of the group of new rolls fitted with chocks from the shuttle 200' onto the car 100.

Figure 3J:
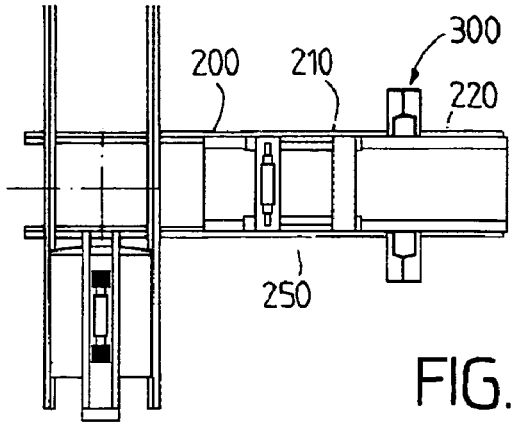

Finally, in FIG. 3J, the shuttle 200' is again placed in a removed position in a manner so as to free up the traversing path of the car 100. At this point in the method, the shuttle 200' bears the group of worn rolls without chocks.

Then the car 100 is moved to its advanced position in such a way that the actuation of the roll displacement means allows the insertion of the group of rolls fitted with chocks into the corresponding mill stand 10.

In the embodiment in FIGS. 1 and 2, it is the shuttle 200 in its entirety that is moved to the chock extraction device 300.

In a particular embodiment, the shuttle is capable of going back to the rolls workshop, the rails 220 leading to that zone of the rolling mill installation. Thus, the group of worn rolls without chocks is transported to the workshop in order to be re-ground there. The shuttle 200 can then be preloaded with a group of new rolls without chocks, and then moved again into the roll change-over zone at the foot of the rolling mill, in a standby position with a view to the next roll change-over cycle.

This embodiment is advantageous in that the routing of the rolls to the workshop can be accomplished simultaneously with the stage of inserting the rolls into the mill stand. This is of interest if a plurality of change-over cycles is realized one after the other.

In a variant, it is the car 100 that allows the worn rolls to be transported to the workshop. Then, the method described above proceeds by transferring the worn rolls without chocks from the shuttle 200 to the car 100. Then the car 100 is moved to the rolls workshop where the worn rolls are unloaded and replaced by new rolls. The car 100 is moved once again to the roll change-over zone. The shuttle 200 is subsequently moved in order for the second exchange frame 231 to be situated in the principal plane P of the car under consideration. The new rolls without chocks are then loaded onto the shuttle 200, which is moved away into a standby position with a view to the next roll change-over cycle. It will be noted that the "next roll change-over cycle" can involve one of the other mill stands and use one of the cars other than the car under consideration.

This embodiment is particularly suitable for a rolling mill where it is not necessary to undertake the simultaneous replacement of all the groups of rolls, but instead where the replacements are accomplished successively.

It is easy to see that, according to the method of the invention, the change-over of the rolls is carried out very quickly in such a way that the time during which the production line is interrupted is extremely short.

Moreover, the chocks of the worn rolls that have just been extracted from the mill stands have been coupled to the new rolls that have immediately replaced these worn rolls. It is therefore not necessary to arrange additional pairs of chocks, except possibly spare pairs of chocks in case of breakage of equipment. Whereas for example 3 sets of chocks per mill stand, that is to say 9 sets of chocks (56 chocks), were set up in the past for a six-high rolling mill with 3 mill stands, now one set per mill stand, that is to say three sets of chocks (24 chocks), is sufficient with the installation according to the invention.

Obviously, an installation of this type offers the possibility of using a larger number of sets of chocks if it is wished to give priority to the service lifetime of the chocks and their bearings.

Although the invention has been described by referring to a particular embodiment, it is by no means limited to this embodiment. It covers all the technical equivalents of the means described as well as combinations thereof that fall within the framework of the invention.

In the drawings of FIG. 3, an embodiment has been represented in which the shuttle 200 comprises a first exchange frame in order to accommodate the worn rolls and a second exchange frame in order to accommodate the new rolls. But in a variant, the transfer of the groups of new or worn rolls from a plurality or all of the cars 100 *a-c* could be realized simultaneously. For this purpose, the suitable shuttle will comprise N pairs of exchange frames: the first and second exchange frames of the same pair are spaced from each other by the pitch k; and the first exchange frames of two successive pairs are spaced from each other according to the length of the shuttle by the spacing e between the principal planes P of the mill stands a-c. In this configuration, the transfers of the N groups of worn rolls from the cars to the first exchange frames of the shuttle can be realized at the same time. Then the shuttle is moved by the pitch k according to the axis A'. The groups of new rolls are loaded from the second exchange frames of the shuttle onto the N cars simultaneously. The shuttle is subsequently moved away in order for the N cars to be advanced close to the associated mill stands in order to insert the new groups in a single operation.

In yet another variant of implementation of the method according to the invention and therefore of the shuttle device, the latter comprises a series of N+1 exchange frames, where N is the number of mill stands and cars of the rolling mill installation. In this embodiment represented in FIG. 1, the exchange frames are spaced from each other by a pitch k. In the following, the adjective "first" qualifies for example the element of a series located furthest to the left in FIG. 1, the other elements of the series being indicated in an incremental manner from left to right.

At the outset, the shuttle is placed furthest to the left along the axis A'. The first three exchange frames comprise groups of new rolls fitted for example with chocks, while the fourth exchange frame is empty.

The empty fourth exchange frame is positioned in the principal plane of the first car 100 *c*. The group of worn rolls is moved from the first car 100 *c* into the fourth exchange frame. The shuttle is subsequently offset by the pitch k to the right, along the axis A', in such a way that the third exchange frame is now positioned in the principal plane P of the first car 100 *c*. The new rolls fitted with chocks are then loaded onto the car c, thereby freeing up the third exchange frame of the shuttle.

The shuttle is subsequently moved over a distance e in order that the third exchange frame, which is now empty, is placed in the principal plane of the car 100 *b*. The worn rolls of the car 100 *b* are loaded into the third exchange frame. The shuttle is moved by the pitch k in such a way that the second exchange frame, comprising the new rolls, is placed in the principal plane of the car 100*b*. The new rolls are then loaded onto the car 100 *b*.

The method proceeds little by little in order to replace the load of each of the N cars. Finally, once the entirety of the cars bears groups of new rolls fitted with chocks, the first exchange frame of the shuttle is empty while the other exchange frames of the shuttle comprise groups of worn rolls equipped with chocks.

Obviously, the stages of extracting the chocks of the worn rolls and their coupling onto the new rolls can be inserted into the sequence of operations that has just been described.

Thus, the method according to the invention permits an automated replacement of the rolls without human intervention. In particular, the extraction of the chocks and also their mounting on new rolls is accomplished on line, in the immediate vicinity of the mill stands of the rolling mill and, by way of advantage, only the rolls without chocks return to the remote rolls workshop.

The invention claimed is:

1. A method for replacing at least one pair of rolls of a rolling mill stand during a downtime period in production between a stoppage of the rolling mill and its restarting, the method comprising the following steps:

advancing a first car associated with a mill stand under consideration to an advanced position close to the mill stand;

stopping rolling operations;

actuating roll displacement means fitted to the first car to extract worn rolls fitted with chocks from the mill stand, by sliding along their respective axes, to place them on a replacement frame fitted on the car;

retracting the first car to a retracted position away from the mill stand;

moving a second car, equipped with an empty first exchange frame and a second exchange frame bearing new rolls without chocks, to a first position having the first exchange frame aligned with the replacement frame of the first car;

actuating the roll displacement means of the first car to transfer the worn rolls fitted with chocks from the replacement frame to the first exchange frame of the second car;

aligning the first exchange frame of the second car with a chock extraction device mounted on the second car;

operating the chock extraction device to uncouple the chocks from ends of the worn rolls placed in the first exchange frame;

aligning the second exchange frame of the second car with the chock extraction device;

carrying out the aligning of the first exchange frame or the second exchange frame with the chock extraction device by actuating transposing means supporting the first and second exchange frames of the second car;

operating the chock extraction device to couple the chocks to ends of the new rolls placed in the second exchange frame;

moving the second car to a second position having the second exchange frame aligned with the replacement frame of the first car;

actuating the roll displacement means to slide the new rolls fitted with chocks from the second exchange frame to the replacement frame;

advancing the first car to the advanced position;

actuating the roll displacement means to insert the new rolls fitted with chocks from the replacement frame into the associated mill stand; and restarting rolling operations.

2. The method as claimed in claim 1, wherein the second car is moved to a rolls workshop where the first exchange frame is emptied of the worn rolls without chocks and the second exchange frame is loaded with new rolls without chocks, the second car being moved once again into the roll change-over zone into a standby position with a view to the next roll change-over cycle.

3. The method as claimed in claim 2, wherein, since the first car is being moved to the rolls workshop, the method comprising:

after having inserted the new rolls fitted with chocks in the mill stand, retracting the car to the retracted position, aligning the first exchange frame of the second car with the replacement frame of the first car, actuating the roll replacement means of the first car in order to slide the worn rolls from the first exchange frame into the replacement frame of the first car, setting the first car in motion toward the rolls workshop where the replacement frame is emptied of the worn rolls without chocks and then loaded with the new rolls without chocks, setting the first car in motion toward the roll change-over zone close to the rolling mill in its retracted position, aligning the second exchange frame of the shuttle device with the first replacement frame of the car, and actuating the roll replacement means in order to slide the new rolls without chocks from the replacement frame to the second exchange frame with a view to the next roll change-over cycle.

4. An installation for on-line replacement of at least one pair of rolls of a rolling mill, the installation comprising:

a plurality of mill stands disposed in series along an axis of rolling;

rails disposed perpendicular to said axis of rolling;

rails disposed parallel to said axis of rolling;

a plurality of first dismantling cars being equal in number to said plurality of mill stands, each of said first dismantling cars serving one respective associated mill stand and being moved along said rails disposed perpendicular to said axis of rolling, between a retracted position and an advanced position with respect to said associated mill stand, each of said first dismantling cars being fitted with a replacement frame to accommodate a group of rolls and roll displacement means allowing the rolls to be slid parallel to their respective axes over a given distance outside and inside a replacement frame;

a second dismantling car configured to be moved along said rails disposed parallel to said axis of rolling and including first and second exchange frames; and at least one chock extraction device disposed on said second dismantling car and allowing chocks to be coupled and uncoupled at ends of rolls aligned with said chock extraction device;

said second dismantling car including transposing means for moving said first and second exchange frames with respect to said chock extraction device.

5. The installation as claimed in claim 4, wherein the second car comprises a number of exchange frames that is greater by one unit than the number of mill stands and first cars of the rolling mill.

6. The installation as claimed in claim 4, wherein the second car comprises a number of exchange frames that is equal to twice the number of mill stands and first cars of the rolling mill.

7. The installation as claimed in claim 4, wherein the second car allows rolls to be transported from one roll change-over zone close to the rolling mill to a rolls workshop, and vice versa.

* * * * *